US006499804B1

(12) United States Patent
Wu

(10) Patent No.: US 6,499,804 B1
(45) Date of Patent: Dec. 31, 2002

(54) EASY CHAIR DEVICE

(76) Inventor: Chung-Sen Wu, 3F, No. 8, Lone 295, Sec. 1, Fu Sing Nan Rd., Taipei (TW)

( * ) Notice: Subject to any disclaimer, the term of this patent is extended or adjusted under 35 U.S.C. 154(b) by 0 days.

(21) Appl. No.: 10/087,106

(22) Filed: Mar. 1, 2002

(51) Int. Cl.[7] ..... A47C 4/00
(52) U.S. Cl. ..... 297/381; 297/380; 297/25; 297/45
(58) Field of Search ..... 297/16.1, 25, 26, 297/42, 45, 380, 381

(56) References Cited

U.S. PATENT DOCUMENTS 1,241,544 A * 10/1917 Ostman ..... 297/26
1,963,708 A * 6/1934 Marvin ..... 297/31
3,123,395 A * 3/1964 Glass ..... 297/30
5,446,433 A * 8/1995 Avihod ..... 297/380
5,779,314 A * 7/1998 Grace ..... 297/25
6,082,813 A * 7/2000 Chen ..... 297/16.2

* cited by examiner

*Primary Examiner*—Anthony D. Barfield
(74) *Attorney, Agent, or Firm*—Alan Kamrath; Rider, Bennett, Egan & Arundel, LLP

(57) ABSTRACT

An easy chair device has a leg frame, and a chair main body disposed on the leg frame. Two backrest support rods and two armrest support rods extend upward from the leg frame. The chair main body has a backrest, a seat, and two armrests. The armrests are supported by the armrest support rods and the backrest support rods. A back band is disposed on a back of the backrest. Two fasteners are disposed on two ends of the back band. Two fastening bands are disposed on the armrests to engage with the back band.

3 Claims, 5 Drawing Sheets

EASY CHAIR DEVICE

BACKGROUND OF THE INVENTION

The present invention relates to an easy chair device. More particularly, the present invention relates to an easy chair device which has a back band engaging with two fastening bands to fit a waist of a user.

A conventional easy chair does not have a back band to be adjusted in order to adjust a backrest according to a waist of a user. Therefore, a user will feel uncomfortable while the user sits on the conventional easy chair.

SUMMARY OF THE INVENTION

An object of the present invention is to provide an easy chair device which has a back band and two fastening bands to be adjusted in order to adjust a backrest according to a waist of a user.

Accordingly, an easy chair device comprises a leg frame, and a chair main body disposed on the leg frame. Two backrest support rods extend upward from the leg frame. Two armrest support rods extend upward from the leg frame. The chair main body has a backrest, a seat connected to the backrest, and two armrests. Two rear positioning mounts enclose the backrest support rods. Two front positioning mounts enclose the armrest support rods. The seat is supported by the rear positioning mounts and the front positioning mounts. The armrests are supported by the armrest support rods and the backrest support rods. A back band is disposed on a back of the backrest. Two fasteners are disposed on two ends of the back band. Two fastening bands are disposed on the armrests to engage with the back band.

DETAILED DESCRIPTION OF THE INVENTION

Figure 1:
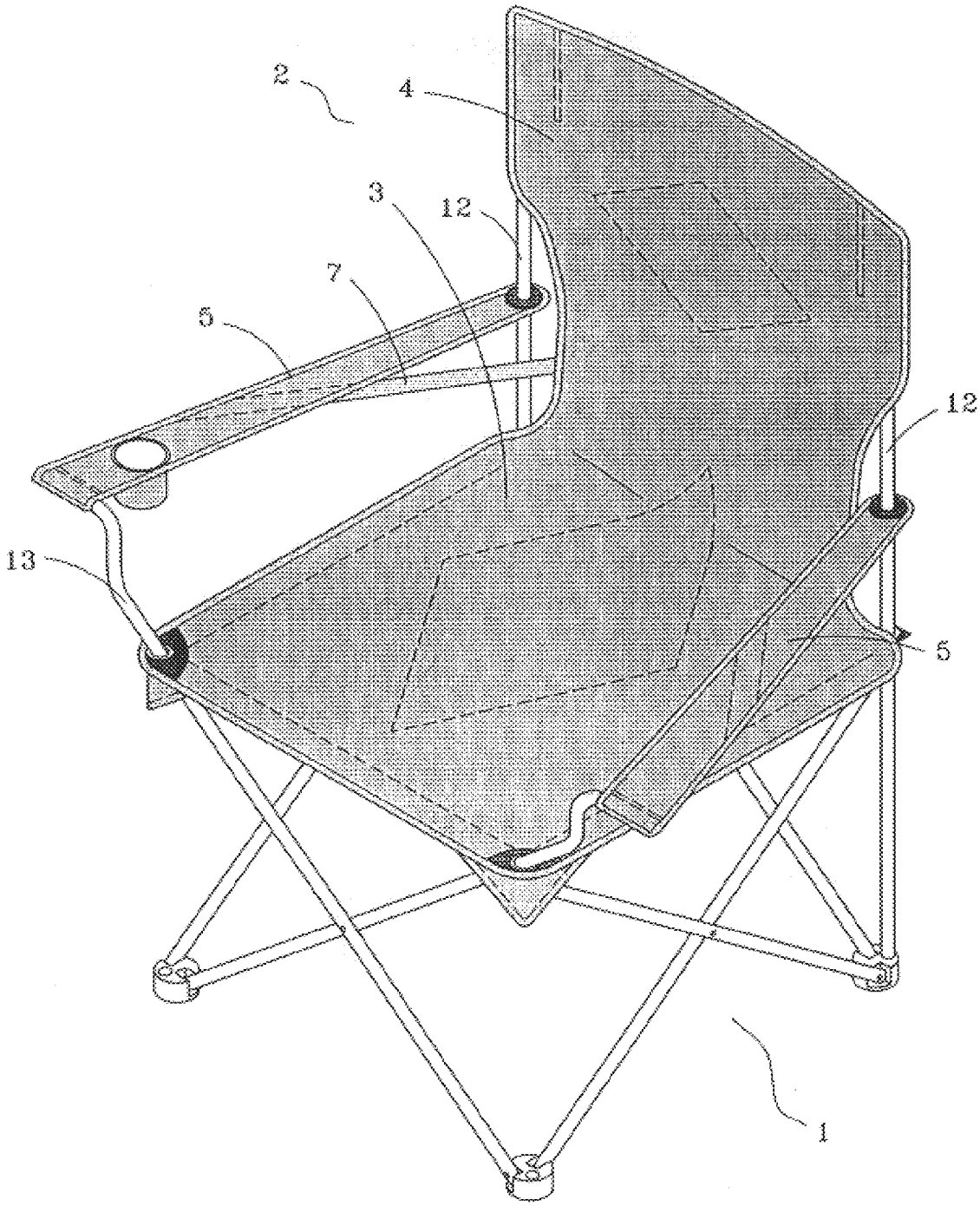
FIG. 1 is a perspective view of an easy chair device of a preferred embodiment in accordance with the present invention.
Figure 2:
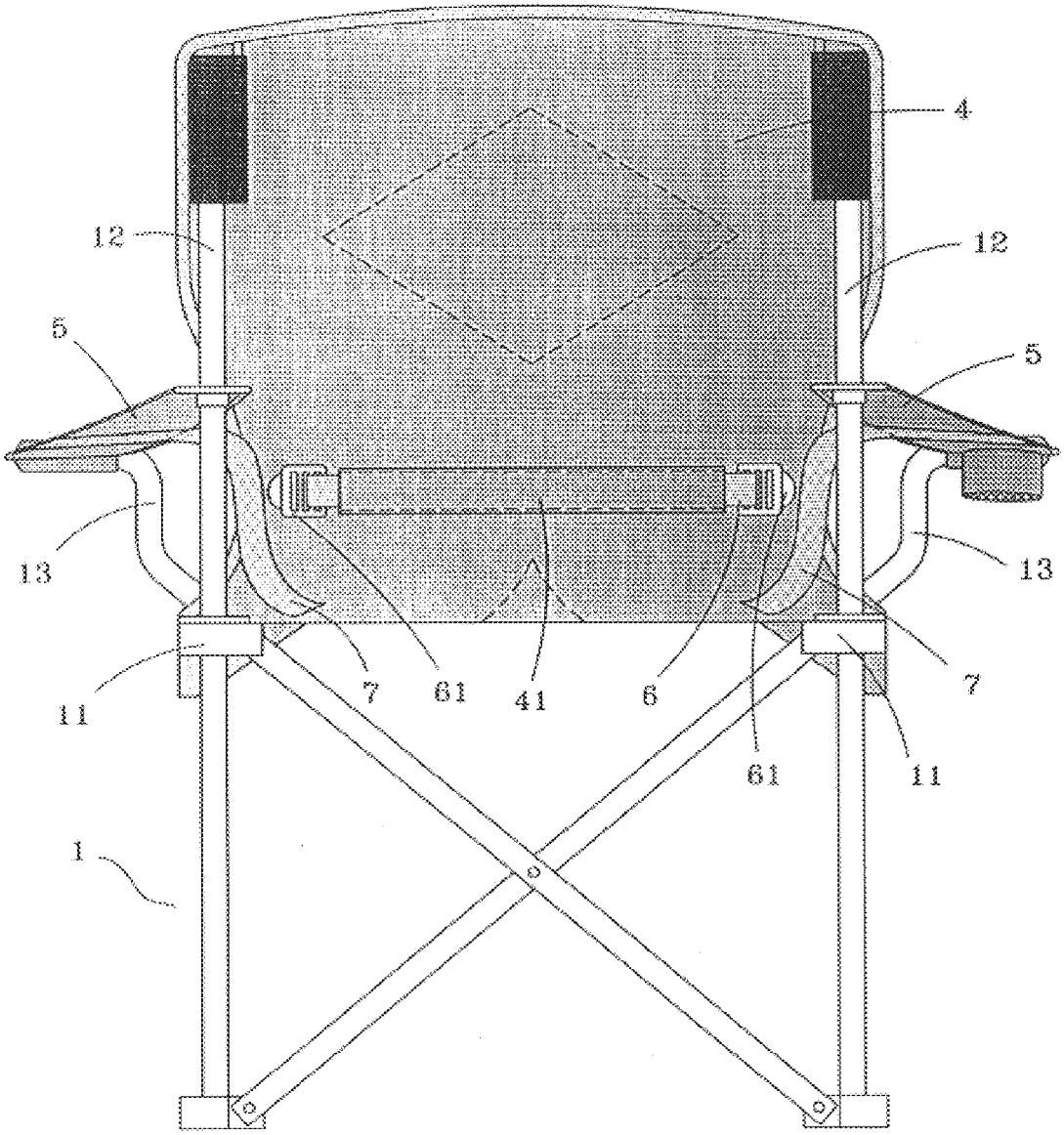
FIG. 2 is a rear elevational view of an easy chair device of a preferred embodiment while a back band does not engage with two fastening bands.
Figure 3:
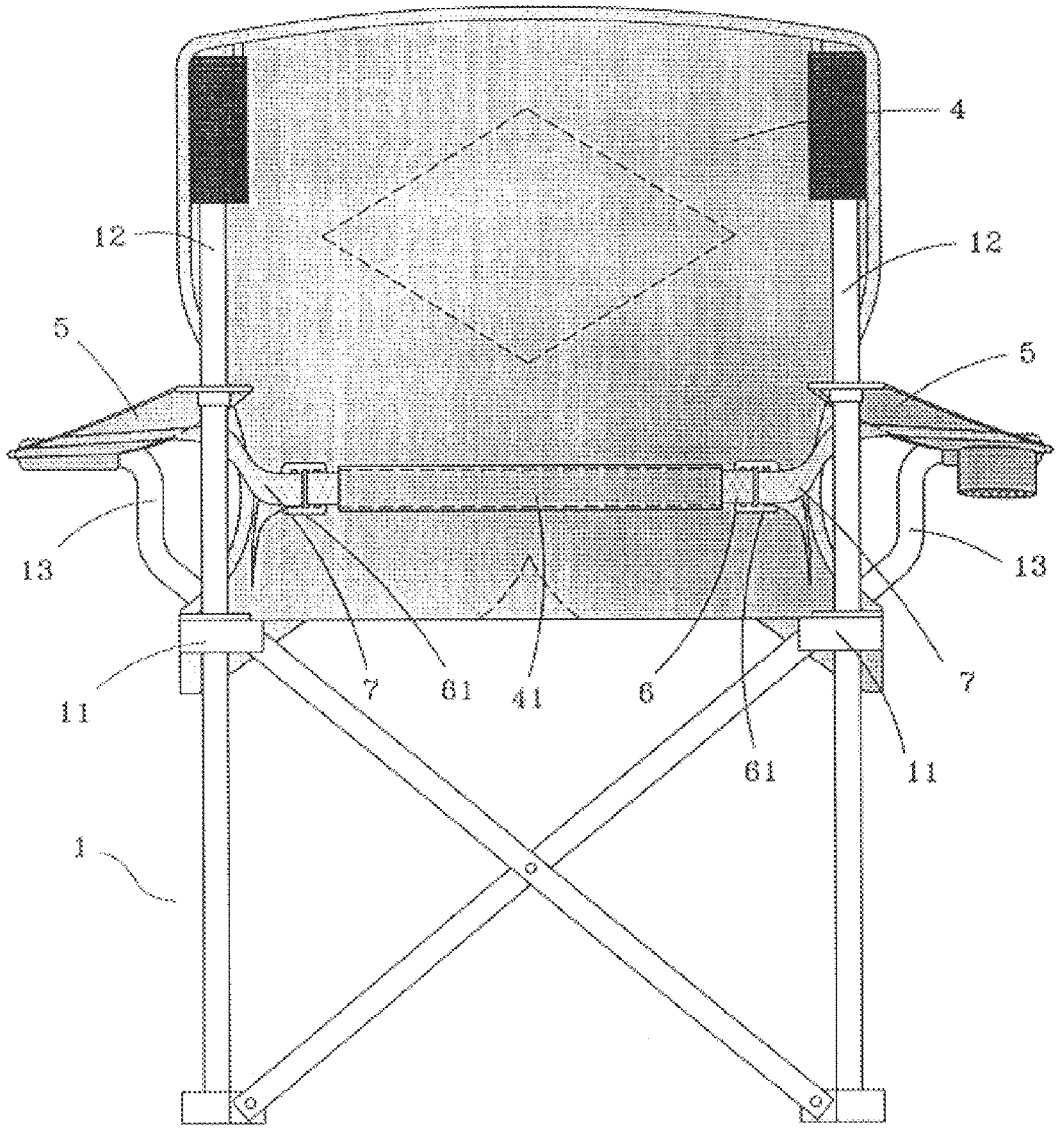
FIG. 3 is a rear elevational view of an easy chair device of a preferred embodiment while a back band engages with two fastening bands.

Referring to FIGS. 1 to 5, an easy chair device comprises a leg frame 1, and a chair main body 2 disposed on the leg frame 1.

Two backrest support rods 12 extend upward from the leg frame 1.

Two armrest support rods 13 extend upward from the leg frame 1.

The chair main body 2 has a backrest 4, a seat 3 connected to the backrest 4, and two armrests 5.

Two rear positioning mounts 11 enclose the backrest support rods 12.

Two front positioning mounts 11*a* enclose the armrest support rods 13.

The seat 3 is supported by the rear positioning mounts 11 and the front positioning mounts 11*a*.

The armrests 5 are supported by the armrest support rods 13 and the backrest support rods 12.

A back band 6 is disposed on a back of the backrest 4.

Two fasteners 61 are disposed on two ends of the back band 6.

Two fastening bands 7 are disposed on the armrests 5 to engage with the back band 6.

A hollow casing 41 is disposed on a back of the backrest 4. The back band 6 passes through the hollow casing 41.

Each of the fastening bands 7 is disposed on a bottom of the corresponding armrest 5.

Figure 4:
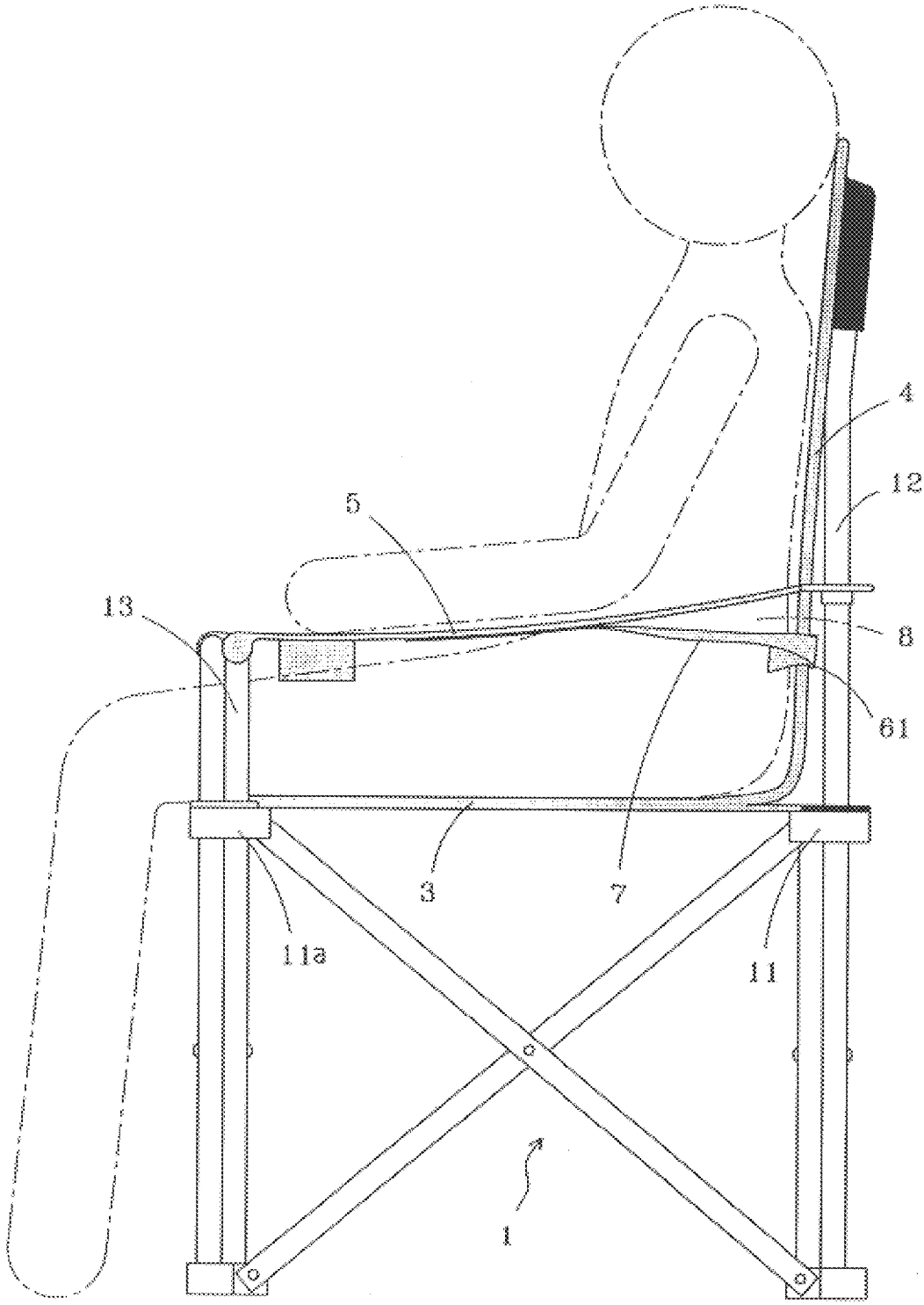
FIG. 4 is a schematic view illustrating a back of a user is upright while the user sits on an easy chair device of a preferred embodiment in accordance with the present invention.

Referring to FIG. 4, the fastening bands 7 engage with the back band 6 loosely while a user sits upright.

Figure 5:
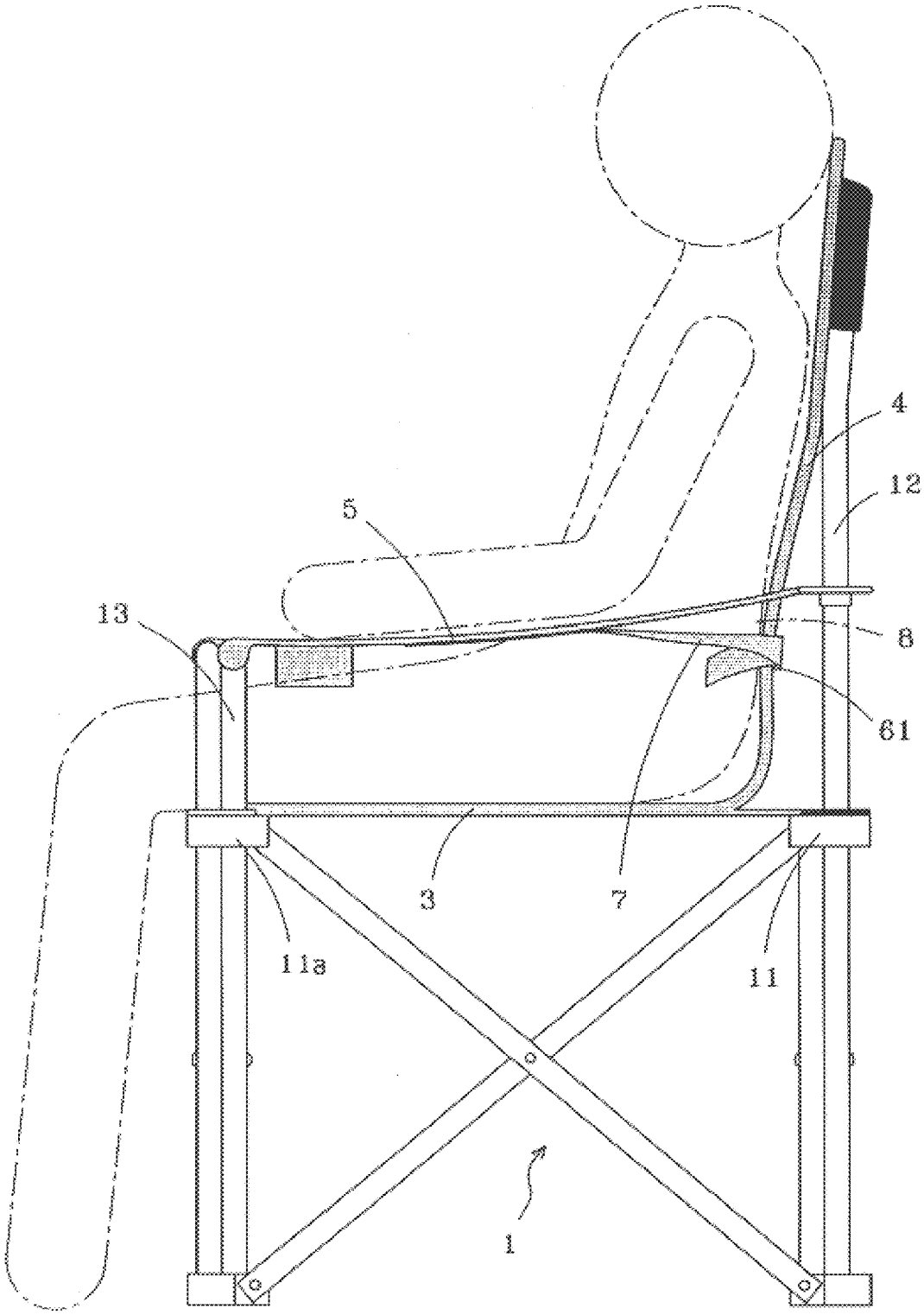
FIG. 5 is a schematic view illustrating a back of a user is inclined while the user sits on an easy chair device of a preferred embodiment in accordance with the present invention.

Referring to FIG. 5, the fastening bands 7 engage with the back band 6 tightly while the user sits slantly.

When the back band 6 and the fastening bands 7 are adjusted, the backrest 4 is adjusted according to a waist of the user.

The present invention is not limited to the above embodiment but various modification thereof may be made. Furthermore, various changes in form and detail may be made without departing from the scope of the present invention.

I claim:

1. An easy chair device comprises:

a leg frame, a chair main body disposed on the leg frame, two backrest support rods extending upward from the leg frame, two armrest support rods extending upward from the leg frame, the chair main body having a backrest, a seat connected to the backrest, and two armrests, two rear positioning mounts enclosing the backrest support rods, two front positioning mounts enclosing the armrest support rods, the seat supported by the rear positioning mounts and the front positioning mounts, the armrests supported by the armrest support rods and the backrest support rods, a back band disposed on a back of the backrest, two fasteners disposed on two ends of the back band, and two fastening bands disposed on the armrests to engage with the back band.

2. The easy chair device as claimed in claim 1, wherein a hollow casing is disposed on a back of the backrest, and the back band passes through the hollow casing.

3. The easy chair device as claimed in claim 1, wherein each of the fastening bands is disposed on a bottom of the corresponding armrest.

* * * * *